US011441787B2

(12) United States Patent
Tateishi et al.

(10) Patent No.: US 11,441,787 B2
(45) Date of Patent: Sep. 13, 2022

(54) HOT-WATER SUPPLY DEVICE

(71) Applicant: NORITZ CORPORATION, Hyogo (JP)

(72) Inventors: Shingo Tateishi, Akashi (JP); Hiroki Nabeshima, Kobe (JP); Hideki Nomura, Akashi (JP); Takanobu Kaneshiro, Miki (JP); Hiromi Yamanishi, Hyogo (JP); Ryo Hasegawa, Akashi (JP); Kenichiro Yasukawa, Himeji (JP)

(73) Assignee: NORITZ CORPORATION, Hyogo (JP)

( * ) Notice: Subject to any disclaimer, the term of this patent is extended or adjusted under 35 U.S.C. 154(b) by 63 days.

(21) Appl. No.: 17/096,889

(22) Filed: Nov. 12, 2020

(65) Prior Publication Data

US 2021/0156570 A1 May 27, 2021

(30) Foreign Application Priority Data

Nov. 25, 2019 (JP) ..... JP2019-212536

(51) Int. Cl.

| | |
|---|---|
| ***F24D 17/00*** | (2022.01) |
| ***F24D 19/10*** | (2006.01) |
| ***F24H 9/13*** | (2022.01) |
| ***E03C 1/044*** | (2006.01) |

(52) U.S. Cl.

CPC ..... *F24D 17/0078* (2013.01); *E03C 1/044* (2013.01); *F24D 19/1051* (2013.01); *F24H 9/139* (2022.01); *F24D 2220/0207* (2013.01); *F24D 2220/042* (2013.01);

(Continued)

(58) Field of Classification Search

CPC ..... Y10T 137/6497; Y10T 137/6579; Y10T 137/85954; F24D 19/1051; F24D 17/0078; F24H 9/139; E03C 1/044

See application file for complete search history.

(56) References Cited

U.S. PATENT DOCUMENTS

2007/0257122 A1* 11/2007 Shimada ..... F23N 1/082 237/12
2011/0042470 A1* 2/2011 Deivasigamani ... F24D 19/1051 236/51

(Continued)

FOREIGN PATENT DOCUMENTS

| | | |
|---|---|---|
| JP | H0674560 | 3/1994 |
| JP | 2526463 | 8/1996 |

*Primary Examiner* — Atif H Chaudry
(74) *Attorney, Agent, or Firm* — JCIPRNET

(57) ABSTRACT

Provided is a hot-water supply device. A process performed by a control device of the hot-water supply device includes: a step of shifting an action mode of the hot-water supply device to an instant hot-water mode; a step of measuring an amount of water X; a step of determining that another tap interruption occurs when the amount of water X is equal to or greater than a basic flow amount Y+α; a step of stopping action of a circulation pump; a step of re-learning the amount of water X when the amount of water X is less than a basic flow amount Y−β; a step of ending the instant hot-water circulation mode when an end condition of the instant hot-water mode is satisfied; and a step of measuring the amount of water X when the end condition of the instant hot-water mode is not satisfied.

18 Claims, 5 Drawing Sheets

(52) U.S. Cl.
CPC .... *Y10T 137/6497* (2015.04); *Y10T 137/6579* (2015.04); *Y10T 137/85954* (2015.04)

(56) References Cited

U.S. PATENT DOCUMENTS

| | | | | |
|---|---|---|---|---|
| 2012/0090341 | A1* | 4/2012 | Hatada | F25B 27/00 62/238.7 |
| 2012/0138149 | A1* | 6/2012 | Hatada | G05B 15/02 122/367.1 |

* cited by examiner

HOT-WATER SUPPLY DEVICE

CROSS-REFERENCE TO RELATED APPLICATION

This application claims the priority benefit of Japan Patent Application No. 2019-212536, filed on Nov. 25, 2019. The entirety of each of the above-mentioned patent applications is hereby incorporated by reference herein and made a part of this specification.

BACKGROUND

Technical Field

The disclosure relates to control of a hot-water supply device, and more particularly relates to control of a hot-water supply device having an instant hot-water function.

Related Art

A hot-water supply temperature may be unstable during hot-water supply performed by a hot-water supply device. Regarding stabilization of the hot-water supply temperature, for example, Japanese Patent Laid-Open No. Hei 6-74560 (patent literature 1) discloses "a control method which can mitigate generation of high-temperature hot-water supply and destabilization of a hot-water supply temperature due to post-boiling at the time of hot-water re-discharge of a water-mixing type hot-water supplier" (see [Abstract]). In addition, Japanese Patent No. 2526463 (patent literature 2) discloses "a hot-water supply control device which includes a bypass path for bypassing a heat exchanger, prevents generation of wraparound of cool water in a hot-water supply stopping state, and has an improved hot-water re-discharge characteristic capable of re-discharging hot water at a hot-water temperature close to a set temperature" (see [Abstract]).

SUMMARY

In a hot-water supply device having an instant hot-water function, there is a possibility that when another tap (for example, a hot-water supply tap of a sink) is used during instant hot-water running, variation in a flow amount with respect to a can body increases due to pressurization of a circulation pump of the hot-water supply device, the precision of judgment of another tap decreases, and switching from an instant hot-water mode to a hot-water supply mode cannot be made. Thus, there is a need for a technique for appropriately switching an action mode of the hot-water supply device.

The disclosure is completed in view of the background as described above, and an object in one aspect is to provide a technique for safely performing hot-water supply and instant water heating.

According to one embodiment, a hot-water supply device having plural action modes is provided. The plural action modes include a hot-water supply mode in which warm water is supplied to the outside of the hot-water supply device, and an instant hot-water circulation mode in which water is circulated inside the hot-water supply device. The hot-water supply device includes: a can body which is arranged between a water entry path and a hot-water discharge path; a heat exchanger which is equipped inside the can body and heats water; a circulation pump which is arranged in a circulation passage for sending all or part of water flowing out from the hot-water discharge path of the heat exchanger to the water entry path of the heat exchanger and which is configured to send the water to the heat exchanger; a water amount sensor which measures an amount of water flowing into the heat exchanger; a temperature sensor which measures a temperature of the water flowing into the heat exchanger; a temperature sensor which measures a temperature of water flowing out from the heat exchanger; and a control device which controls an action of the hot-water supply device. The control device switches the instant hot-water circulation mode to the hot-water supply mode based on the fact that, in the instant hot-water circulation mode, when the circulation pump is stopped, the amount of the water flowing into the heat exchanger is equal to or greater than a reference amount specified for starting combustion of the heat exchanger, or water flows out from a hot-water supply tap.

According to one embodiment, occurrence of another tap interruption is detected even when there is no circulation water amount sensor. In addition, hot-water supply and instant water heating can be safely performed.

The above and other objects, features, aspects and advantages of the present invention are apparent from the following detailed description of the present invention which is understood in association with the accompanying drawings.

DESCRIPTION OF THE EMBODIMENTS

Embodiments of the present invention are described below with reference to the drawings. In the following description, the same components are designated by the same signs. Names and functions of these components are also the same. Thus, detailed description thereof is not repeated.

[Hardware Configuration of Hot-Water Supply Device]

Figure 1:
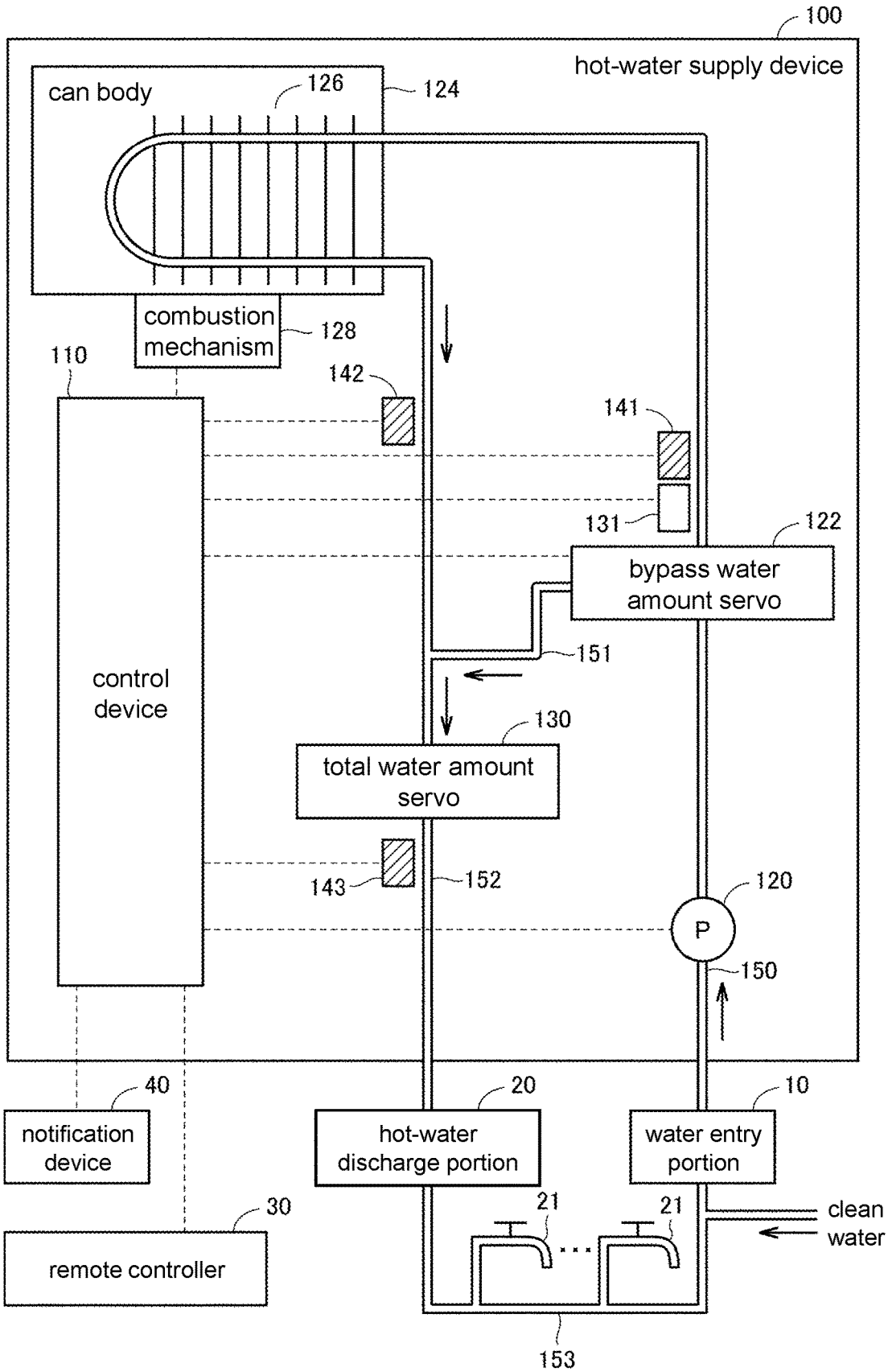
FIG. 1 is a block diagram showing an example of a hardware configuration of a hot-water supply device 100.

First, a configuration of a hot-water supply device 100 according to the embodiment is described with reference to FIGS. 1 and 2. FIG. 1 is a block diagram showing an example of a hardware configuration of the hot-water supply device 100. As shown in FIG. 1, the hot-water supply device 100 includes a control device 110, a circulation pump 120, a bypass water amount servo (also referred to as "bypass servo") 122, a can body 124, a heat exchanger 126, a combustion mechanism 128, a total water amount servo 130, a water amount sensor 131, and temperature sensors 141, 142, and 143. The bypass water amount servo 122 includes a stepping motor (not shown).

The can body 124 is connected to a water entry path 150 and a hot-water discharge path 152. The bypass water amount servo 122 and the hot-water discharge path 152 are connected by a bypass flow path 151. A water entry side of the circulation pump 120 and a hot-water discharge side of the total water amount servo 130 are connected by a flow path 153. More specifically, the flow path 153 connects a water entry portion 10 and a hot-water discharge portion 20. When so-called instant hot-water circulation running is performed, warm water flows through the flow path 153. At least one hot-water supply tap 21 is connected to the flow path 153.

The hot-water supply device 100 receives supply of clean water from the water entry portion 10 and supplies warm water (hot water) from one or more faucets or hot-water supply taps via the hot-water discharge portion 20. When the hot-water supply device 100 does not perform circulation running, the hot-water supply device 100 receives the supply of the clean water from the water entry portion 10. The hot-water supply device 100 is electrically connected to a remote controller 30 and a notification device 40. The action of the hot-water supply device 100 is controlled according to an operation on the remote controller 30. The notification device 40 notifies a state of the hot-water supply device 100 based on a signal sent from the hot-water supply device 100.

The control device 110 respectively receives input of a signal output from the water amount sensor 131, input of signals output from the temperature sensors 141, 142, and 143, and input of a signal transmitted from the remote controller 30. The control device 110 controls the action of the hot-water supply device 100 based on the input signals and setting data specified in advance. More specifically, the control device 110 controls combustion in the hot-water supply device 100, stopping of the combustion, an amount of water supplied to the heat exchanger 126, running of the circulation pump 120, and the like.

The circulation pump 120 circulates water in the flow path 153. In one aspect, the circulation pump 120 is realized by a pump capable of constant output, such as an alternative current (AC) pump. In the hot-water supply device 100, a circulation flow amount may change due to resistance of pipes that configure flow paths of water, resistance of equipment arranged in the flow paths, or the like. At an outlet of the circulation pump 120, the bypass water amount servo 122 and the water amount sensor 131 are arranged in that order.

The bypass water amount servo 122 adjusts (distributes) an amount of water discharged from the circulation pump 120 to an amount of water supplied to the heat exchanger 126 and an amount of water flowing into the bypass flow path 151. The bypass water amount servo 122 can adjust a temperature of warm water from the heat exchanger 126 by adjusting the amount of the water supplied to the heat exchanger 126.

Water flowing into the heat exchanger 126 from the water entry path 150 flows out to the hot-water discharge path 152. The heat exchanger 126 is heated by the combustion mechanism 128. In one aspect, the combustion mechanism 128 is configured by a burner that generates heat by combustion of gas, oil, or the like. The heat exchanger 126 uses the heat generated by the combustion mechanism 128 to raise a temperature of the water introduced by the water entry path 150. Thus, the heat exchanger 126 and the combustion mechanism 128 configure an example of a "heating mechanism".

The water (hot water) whose temperature is raised by the heat exchanger 126 flows into the total water amount servo 130 through the hot-water discharge path 152. The bypass flow path 151 is connected to the hot-water discharge path 152. The high-temperature water output from the heat exchanger 126 is mixed with water (low-temperature water) supplied from the bypass water amount servo 122 through the bypass flow path 151, and the temperature of the high-temperature water may be adjusted to a temperature instructed by the controller 110.

The total water amount servo 130 adjusts the amount of the warm water supplied by the hot-water supply device 100 to the flow path 153 by changing an opening/closing degree of a valve (not shown) based on a signal output from the control device 110. Warm water flowing out from the total water amount servo 130 can be supplied from the hot-water supply tap 21 via the hot-water discharge portion 20. Moreover, part of the warm water flowing out from the total water amount servo 130 is returned to the water entry side of the circulation pump 120 via the flow path 153. When the hot-water supply tap 21 is closed and the warm water flowing out from the total water amount servo 130 is not supplied to the outside of the hot-water supply device 100 through the hot-water discharge portion 20, the hot-water supply device 100 performs instant hot-water circulation running through an instant hot-water circulation flow path composed of the flow path 153, the water entry path 150, and the hot-water discharge path 152. By this instant hot-water circulation running, the hot-water supply device 100 according to one embodiment can supply high-temperature water immediately after opening the hot-water supply tap 21.

The remote controller 30 receives an operation of a user and transmits a signal corresponding to the operation to the hot-water supply device 100. For example, the remote controller 30 receives input of settings for specifying running and stopping of the hot-water supply device 100, a set temperature of warm water to be supplied, and other actions of the hot-water supply device 100. The remote controller 30 is connected to the hot-water supply device 100 in a wired or wireless manner.

The notification device 40 notifies a state of the hot-water supply device 100 based on the signal output from control device 110. In one aspect, the notification device 40 is realized by display, sound, and the like, and outputs information indicating a state of the hot-water supply device 100. A notification form includes voice, image or text, light, and the like. In still another aspect, the notification device 40 can also be realized as a mobile terminal in which a program (app) for realizing notification of the hot-water supply device 100 is installed.

The water amount sensor 131 detects the amount of the water flowing into the heat exchanger 126. The temperature sensor 141 detects the temperature of the water flowing into the heat exchanger 126. The temperature sensor 142 detects the temperature of the warm water flowing out from the can body 124. The temperature sensor 143 detects the temperature of the warm water supplied from the total water amount servo 130.

The hot-water supply device 100 according to the embodiment can control a flow amount to the bypass flow path 151 during the instant hot-water circulation running, and can control the temperature of the hot water flowing in the flow path 153 during the instant hot-water circulation running and the hot-water supply running.

That is, according to the configuration shown in FIG. 1, a circulation flow path included in a conventional hot-water supply device having an instant hot-water function is not arranged inside the hot-water supply device 100, and the circulation pump 120 is arranged in the water entry path 150. The circulation flow path is a flow path for circulating the output of the total water amount servo 130 to the heat exchanger 126.

[Hardware Configuration of Control Device]

Figure 2:
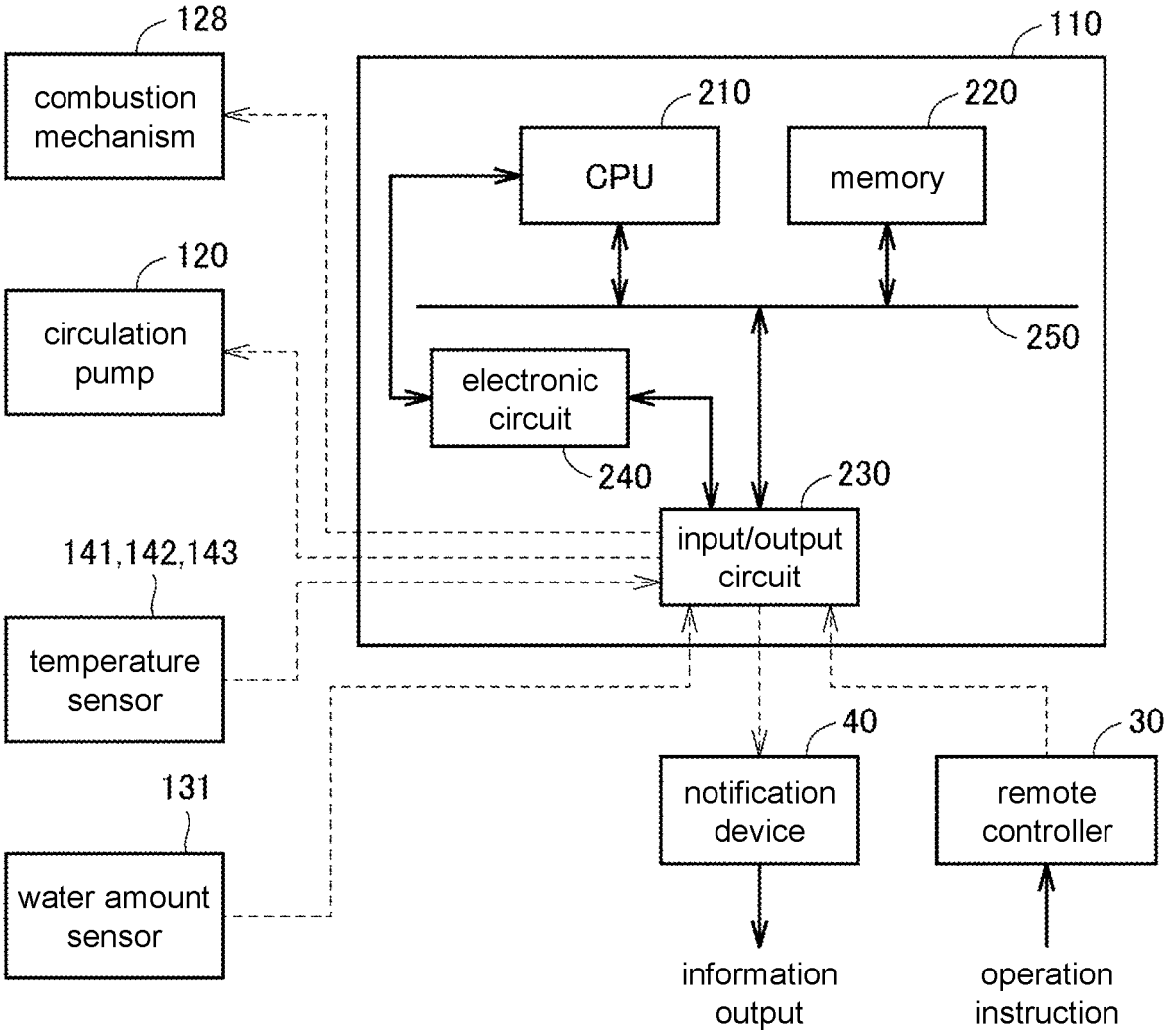
FIG. 2 is a block diagram showing an example of a hardware configuration of a control device 110.

FIG. 2 is a block diagram showing an example of a hardware configuration of the control device 110. The control device 110 is typically configured by a microcomputer. The control device 110 includes a central processing unit (CPU)) 210, a memory 220, an input/output circuit 230, and an electronic circuit 240. The CPU 210, the memory 220, and the input/output circuit 230 can exchange signals with each other via a bus 250. The electronic circuit 240 is configured to execute a preset arithmetic process by dedicated hardware. The electronic circuit 240 can exchange signals between the CPU 210 and the input/output circuit 230.

The CPU 210 respectively receives input of output signals (detection values) from the respective sensors including the temperature sensors 141, 142, and 143 and the water amount sensor 131 through the input/output circuit 230. Furthermore, the CPU 210 receives input of a signal indicating an operation instruction given to the remote controller 30 through the input/output circuit 230. The operation instruction includes, for example, an on/off operation of a running switch of the hot-water supply device 100, the hot-water supply set temperature, and various time reservation settings (also referred to as "timer setting"). The CPU 210 controls an action of each component including the combustion mechanism 128 and the circulation pump 120 in order that the hot-water supply device 100 operates in accordance with the operation instruction.

The CPU 210 can output information that can be visually or acoustically recognized by controlling the notification device 40. For example, the notification device 40 can output the information by displaying visually recognizable information such as texts, figures, and the like. In this case, the notification device 40 can be configured by a display screen of a monitor arranged in the remote controller 30. Alternatively, the notification device 40 may be configured by a speaker and may use voice, melody, or the like to output the information.

[State Transition of Hot-Water Supply Device]

Figure 3:
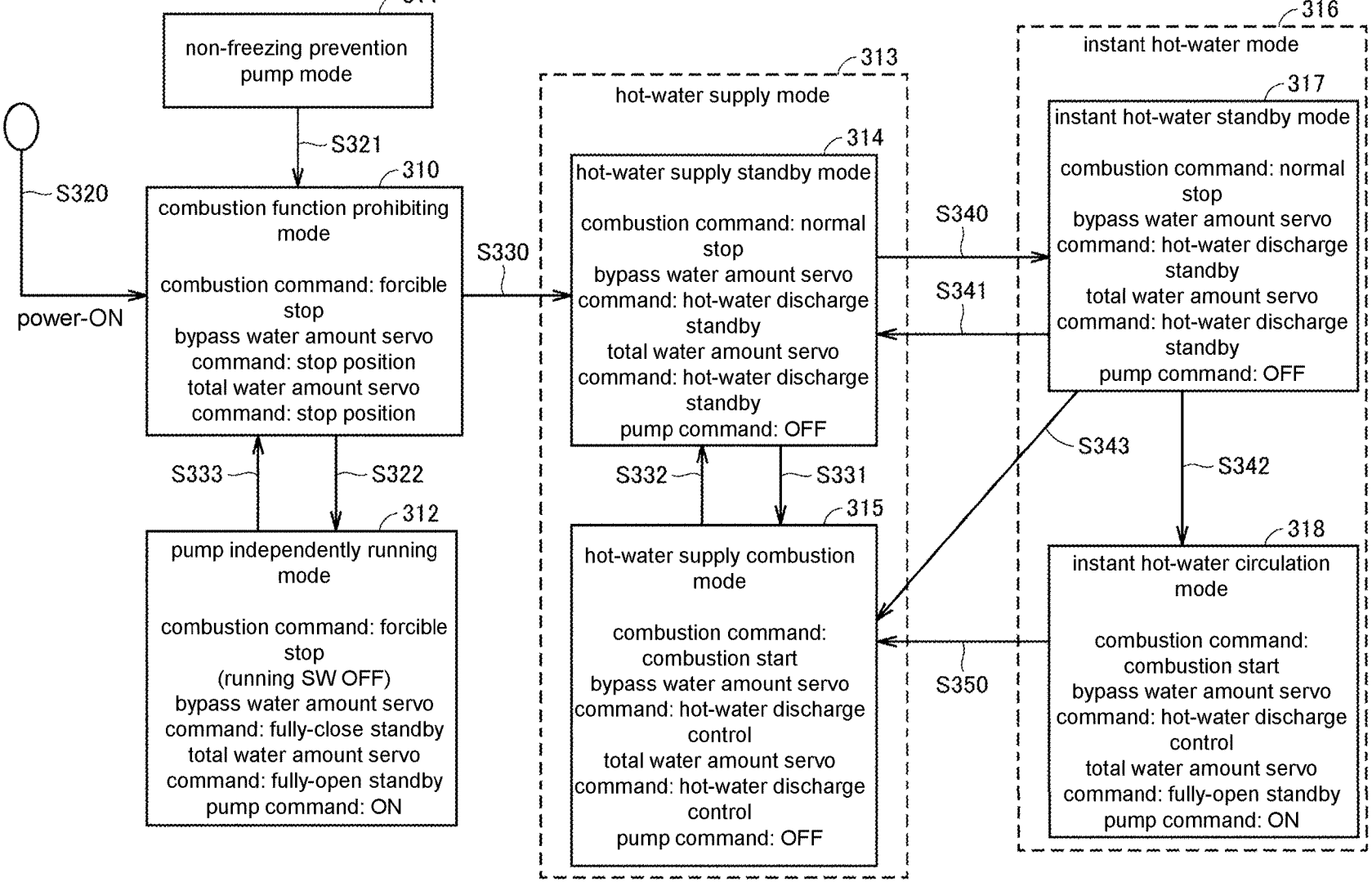
FIG. 3 is a diagram showing state transitions of the hot-water supply device 100 according to an embodiment.

Action modes of the hot-water supply device 100 are described with reference to FIG. 3. FIG. 3 is a diagram showing state transitions of the hot-water supply device 100 according to one embodiment.

As shown in FIG. 3, the action modes of the hot-water supply device 100 include a combustion function prohibiting mode 310, a non-freezing prevention pump mode 311, a pump independently running mode 312, a hot-water supply mode 313, and an instant hot-water mode 316. The hot-water supply mode 313 includes a hot-water supply standby mode 314 and a hot-water supply combustion mode 315. The instant hot-water mode 316 includes an instant hot-water standby mode 317 and an instant hot-water circulation mode 318.

(Combustion Function Prohibiting Mode)

In one aspect, when power of the hot-water supply device 100 is turned on, an action mode of the hot-water supply device 100 is switched to the combustion function prohibiting mode 310 (step S320). In the combustion function prohibiting mode 310, the combustion mechanism is forcibly stopped and combustion is not performed. A command to the bypass water amount servo 122 instructs a stop at a preset position, and the bypass water amount servo 122 maintains the stopped state at the position. Similar to the command to the bypass water amount servo 122, a command to the total water amount servo 130 also instructs a stop at a preset position, and the total water amount servo 130 maintains the stop state at the position. Thereafter, when a preset combustion function is confirmed for the hot-water supply device 100 and it is confirmed that there is no abnormality, the action mode is switched from the combustion function prohibiting mode 310 to the hot-water supply standby mode 314 (step S330).

(Hot-Water Supply Standby Mode)

In the hot-water supply standby mode 314, the hot-water supply device 100 is normally stopped. More specifically, each command from the control device 110 to the bypass water amount servo 122 and the total water amount servo 130 indicates "hot-water discharge standby". A command of the control device 110 to the circulation pump 120 is OFF, and the circulation pump 120 does not operate.

In one aspect, when the hot-water supply tap 21 is opened for hot-water supply, water is introduced into the water entry passage by supply pressure of the water supplied from the water entry portion 10. When the water amount sensor 131 detects an amount of water that exceeds a minimum operation quantity (MOQ), the control device 110 operates the combustion mechanism 128. That is, the hot-water supply device 100 is switched from the hot-water supply standby mode 314 to the hot-water supply combustion mode 315 (step S331).

(Hot-Water Supply Combustion Mode)

When the action mode becomes the hot-water supply combustion mode 315, the control device 110 sends a command for combustion start to the combustion mechanism 128. In response to the command, the combustion mechanism 128 starts the combustion. The control device 110 respectively outputs commands for controlling a hot-water discharge amount to the bypass water amount servo 122 and the total water amount servo 130. The bypass water amount servo 122 and the total water amount servo 130 respectively adjust an opening degree of a valve (not shown) in accordance with the respectively input commands in order that designated hot water is supplied. The command of the control device 110 to the circulation pump 120 remains off and the circulation pump 120 does not operate.

In one aspect, when the hot-water supply tap 21 is closed and the hot-water supply ends, the water amount sensor 131 thereafter detects a flow amount below the MOQ. In response to the detection, the control device 110 outputs a command for stopping combustion to the combustion mechanism 128. In response to the command, the combustion mechanism 128 ends the combustion action. Furthermore, the control device 110 outputs a "hot-water discharge standby" command as each command to the bypass water amount servo 122 and the total water amount servo 130. The bypass water amount servo 122 and the total water amount servo 130 are switched to a preset state as a hot-water discharge standby state. Thereby, the action mode of the hot-water supply device 100 is switched from the hot-water supply combustion mode 315 to the hot-water supply standby mode 314 (step S332).

(Instant Hot-Water Standby Mode)

In the hot-water supply standby mode 314, when post-purge (exhaust action) ends in a case where there is an instant hot-water request or a freezing prevention request, the action mode is switched to the instant hot-water standby mode 317 (step S340). In the embodiment, the instant hot-water request means an instruction that instant water heating is performed only once (also simply referred to as "one instant water heating") at the arrival of a pre-reserved instant hot-water time or within a predetermined time (for example, 30 minutes). In the instant hot-water standby mode 317, when the control device 110 does not detect the instant hot-water request and the freezing prevention request, the action mode is switched to the hot-water supply standby mode 314 (step S341). Moreover, a state of the hot-water supply device 100 in the hot-water supply standby mode 314 and a state of the hot-water supply device 100 in the instant hot-water standby mode 317 are the same.

In one aspect, when the temperature of the temperature sensor 143 that measures the temperature of the warm water flowing out from the heat exchanger 126 is equal to or higher than a temperature specified as a temperature for starting the instant hot-water circulation, the action mode of the hot-water supply device 100 is switched from the instant hot-water standby mode 317 to the instant hot-water circulation mode 318 (step S342).

In another aspect, when it is determined that the circulation pump 120 is stopped (OFF), if the controller 110 detects an amount of water exceeding the MOQ, the action mode is switched from the instant hot-water standby mode 317 to the hot-water supply combustion mode 315 (step S343). Moreover, in another aspect, instead of the measurement value of the temperature sensor 142, a measurement value of the temperature sensor 141 that measures the temperature of the water flowing into the heat exchanger 126 may be used.

(Instant Hot-Water Circulation Mode)

In the instant hot-water circulation mode 318, the control device 110 outputs a command for combustion start to the combustion mechanism 128. In response to the command, the combustion mechanism 128 starts combustion. The control device 110 sends a command for hot-water discharge control to the bypass water amount servo 122. In response to the command, the bypass water amount servo 122 adjusts the opening degree in order to maintain the temperature of the warm water during the instant hot-water circulation at a preset temperature. The control device 110 outputs a fully-open command to the total water amount servo 130. In response to the fully-open command, the total water amount servo 130 fully opens an adjustment valve.

When the temperature of the water flowing into the heat exchanger 126 or the temperature of the water flowing out from the heat exchanger 126 is equal to or higher than a temperature preset for stopping the instant hot-water circulation, or when the use of the hot-water supply tap 21 is detected (so-called another tap interruption is detected) during the running of the instant hot-water circulation, the action mode is switched from the instant hot-water circulation mode 318 to the hot-water supply combustion mode 315 (step S350). That is, the control device 110 sends a command for hot-water discharge control to the total water amount servo 130 in order to also maintain the preset temperature while the warm water is supplied from the hot-water supply device 100. The total water amount servo 130 adjusts an opening degree of the adjustment valve in response to the command.

In one aspect, an upper limit of the set temperature in the instant hot-water mode may be set to an upper limit temperature of the instant water heating. When the reserved running or the one instant water heating is completed and the action mode shifts to the hot-water supply standby mode 314, the upper limit of the hot-water supply set temperature returns to an original value.

(Pump Independently Running Mode)

When the control device 110 detects the freezing prevention request or a pump lock countermeasure request in the combustion function prohibiting mode 310, the action mode of the hot-water supply device 100 is switched from the combustion function prohibiting mode 310 to the pump independently running mode 312 (step S322). Here, the detection of the freezing prevention request refers to, for example, a case where the hot-water discharge temperature or the water entry temperature into the can body 124 is detected to be equal to or lower than a preset reference temperature. The pump lock countermeasure is to drive the circulation pump 120 in order to prevent the fixation of drive components (for example, bearings or the like) of the circulation pump 120 when the circulation pump 120 is stopped. For example, when a state in which the detection value of the water amount sensor 131 is less than the MOQ continues for a preset time while the circulation pump 120 is stopped, the control device 110 detects that the pump lock countermeasure request is generated.

[Pump lock countermeasure] In the pump independently running mode 312, the control device 110 maintains the combustion command as "forcible stop", and the switch of the combustion mechanism 128 remains off. When the control device 110 detects the pump lock countermeasure request, the control device 110 outputs a command for fully-close standby to the bypass water amount servo 122. In response to the command, the bypass water amount servo 122 fully closes a valve on the bypass flow path 151 side. The controller 110 outputs a command for fully-open standby to the total water amount servo 130. In response to the command, the total water amount servo 130 fully opens the valve.

Furthermore, the control device 110 outputs a drive signal to the circulation pump 120. The circulation pump 120 operates in response to the drive signal. In one aspect, the control device 110 periodically transmits, to the circulation pump 120, the drive signal for operating the circulating pump 120 for a short time. Periodicity means, for example, once a day, once a week, or the like, and this time interval is not fixed and can be arbitrarily set by a manufacturer of the hot-water supply device 100 or by the user.

[Freezing prevention] In another aspect, when the control device 110 detects a freezing prevention request, the circulation pump 120 is driven for a preset time in order to prevent freezing of internal and external pipes of the hot-water supply device 100. When the hot-water supply switch is turned on while the circulation pump 120 is driven for freezing prevention, the control device 110 stops the circulation pump 120 and starts normal hot-water supply combustion. In this case, the action mode of the hot-water supply device 100 is switched from the pump independently running mode 312 to the hot-water supply combustion mode 315.

Figure 4:
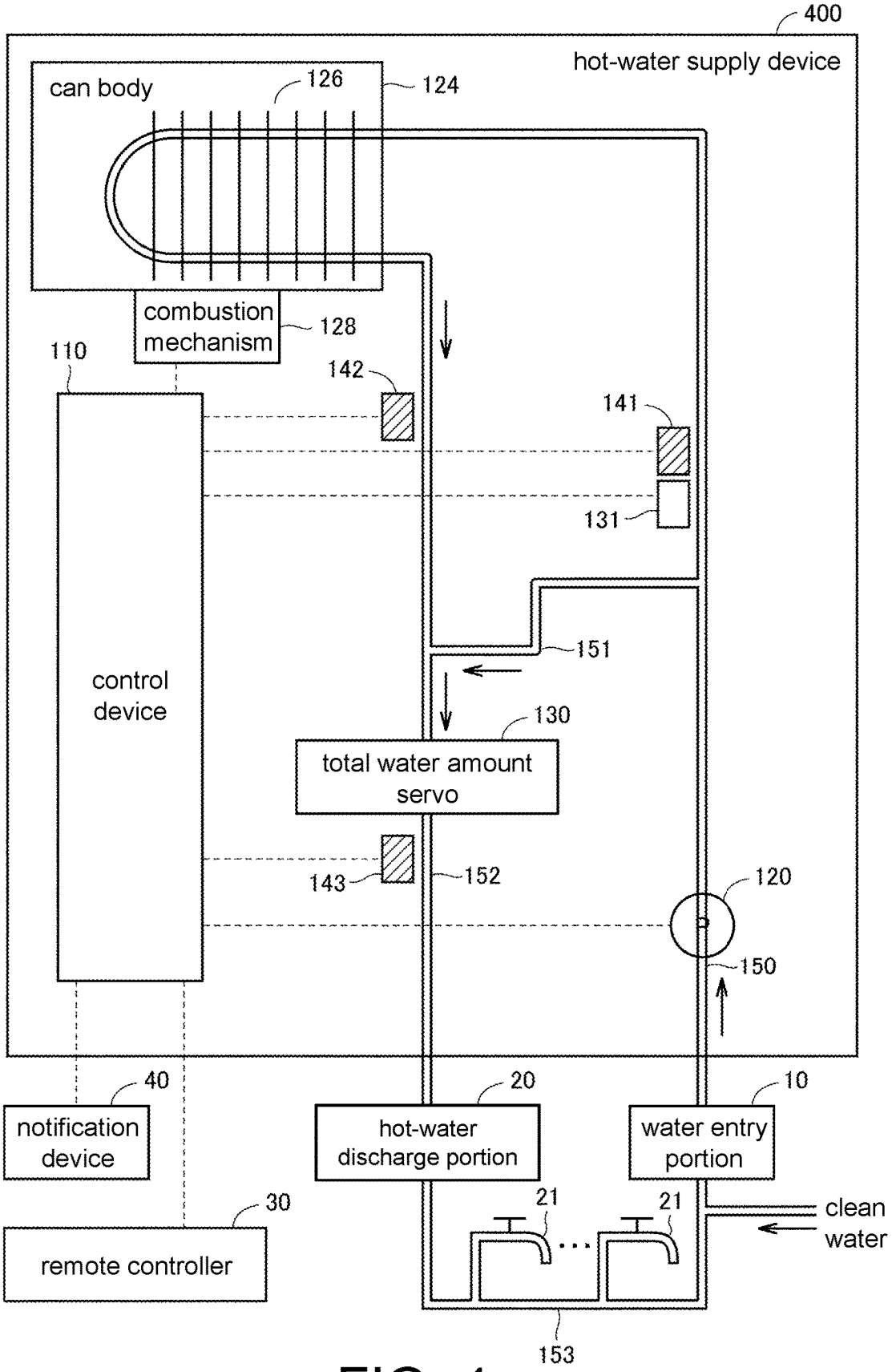
FIG. 4 is a diagram conceptually showing a configuration of a hot-water supply device 400 according to another aspect.

With reference to FIG. 4, a hot-water supply device having another configuration to which the technical idea according to the disclosure is applied is described. FIG. 4 is a diagram conceptually showing a configuration of a hot-water supply device 400 according to another aspect. The hot-water supply device 400 differs from the hot-water supply device 100 in terms of not having the bypass water amount servo 122. That is, all the water delivered from the circulation pump 120 is supplied to the heat exchanger 126 from the water entry path 150. Other configurations are similar to those shown in the hot-water supply device 100. With this configuration, the control device 110 of the hot-water supply device 400 can also detect another tap interruption during the circulation running.

[Control Structure]

Figure 5:
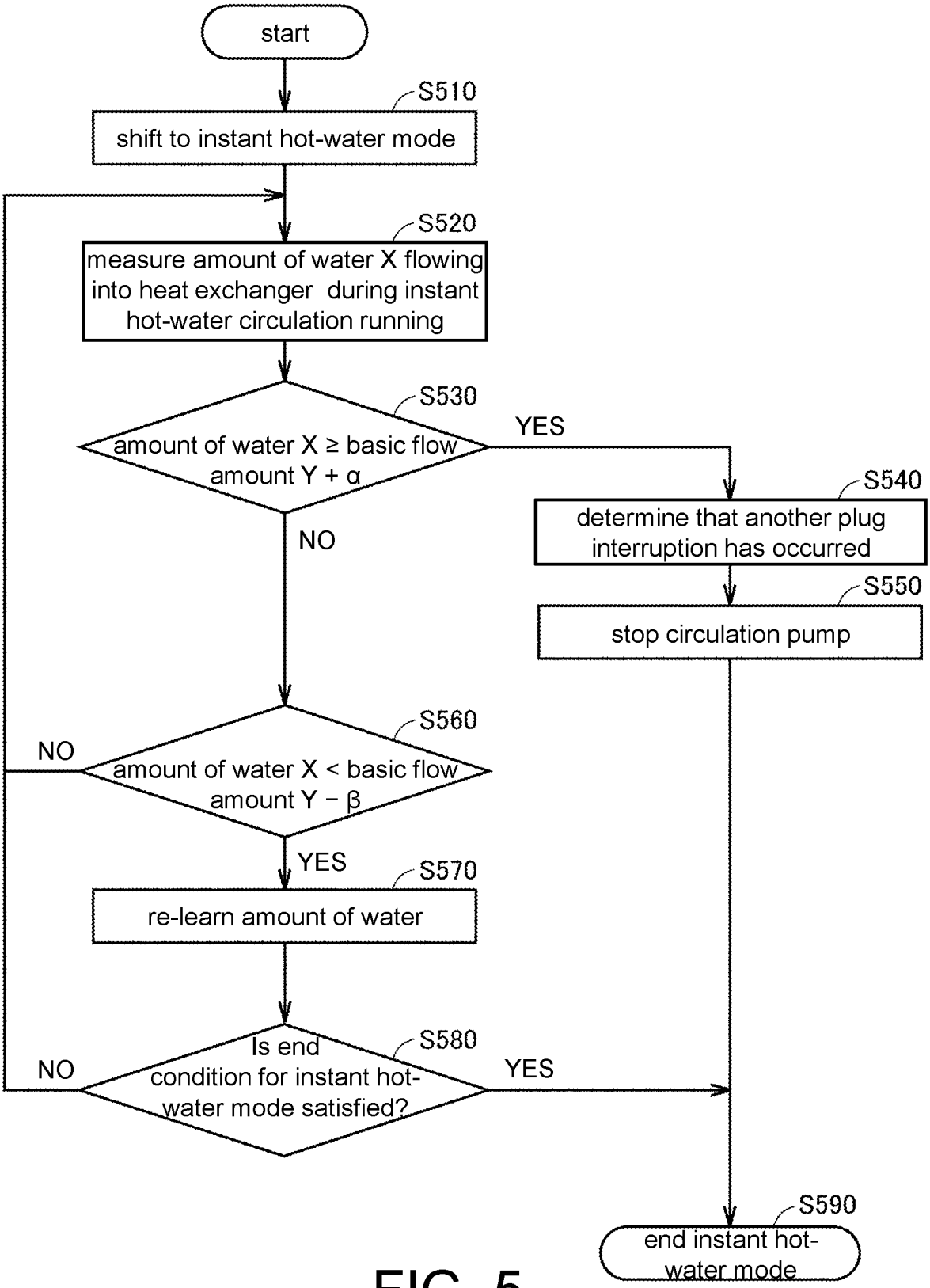
FIG. 5 is a flowchart showing a part of a process executed by the control device 110 included in the hot-water supply device 100 according to one embodiment.

A control structure of the hot-water supply device 100 is described with reference to FIG. 5. FIG. 5 is a flowchart showing a part of a process executed by the control device 110 included in the hot-water supply device 100 according to one embodiment. The following process is realized in a manner that the CPU 210 configuring the control device 110 executes an instruction for realizing the process in one aspect. In another aspect, part or all of the following process may be realized by a combination of circuit elements configured to execute the process. Moreover, in the following description, the action of the hot-water supply device 100 is described, and an action of the hot-water supply device 400 is also similar.

In step S510, the control device 110 shifts the action mode of the hot-water supply device 100 to the instant hot-water mode 316. More specifically, the action mode of the hot-water supply device 100 is the instant hot-water standby mode 317. Thereafter, when a hot-water discharge temperature Ts or a water entry temperature Tc is equal to or higher than a temperature specified for starting the instant hot-water circulation, the control device 110 switches the action mode of the hot-water supply device 100 to the instant hot-water circulation mode 318 (step S342).

In step S520, the control device 110 measures an amount of water X flowing into the heat exchanger 126 during the instant hot-water circulation running based on a detection value of the water amount sensor 131 and stores a measurement result in the memory 220.

In step S530, the control device 110 determines whether the amount of water X is greater than or equal to a basic flow amount $Y+\alpha$. The threshold value $\alpha$ is preset based on a test result of the hot-water supply device 100 and stored in the memory 220. The basic flow amount Y is measured at the time of first running of the hot-water supply device 100, and is stored in the memory 220. Because the output of the circulation pump 120 is constant, the flow amount does not change unless there is another tap interruption. If $X>Y+\alpha$ (YES in step S530), the control device 110 switches the control to step S540. Otherwise (NO in step S530), the control device 110 switches the control to step S570.

In step S540, the control device 110 determines that another tap interruption has occurred. That is, the control device 110 determines that one of the hot-water supply taps 21 is open and hot water flows out.

In step S550, the control device 110 outputs a stop command to the circulation pump 120 to stop the action of the circulation pump 120. When the circulation pump 120 is stopped, the warm water in the hot-water discharge path 152 is not circulated in the water entry path 150 via the flow path 153. The warm water in the hot-water discharge path 152 flows out from the hot-water supply tap 21 via the hot-water discharge portion 20. In this way, energy loss caused by continuing to drive the circulation pump 120 can be prevented.

In step S560, the control device 110 determines whether the amount of water X flowing into the heat exchanger 126 is less than a basic flow amount $Y-\beta$. A threshold value $\beta$ is derived in advance by a test or the like and stored in the memory 220 as a flow amount that can be reduced when a filter (not shown) arranged in the flow paths of the hot-water supply device 100 is clogged with dust or the like. If $X<Y-\beta$ (YES in step S560), the control device 110 switches the control to step S570. Otherwise (NO in step S560), the control device 110 returns the control to step S520.

In step S570, the control device 110 re-learns the basic flow amount Y. More specifically, the control device 110 stores the detection value of the water amount sensor 131 in the memory 220. For example, when the hot-water supply device 100 is used, the filter (not shown) of the circulation pump 120 may be clogged. In this case, the flow amount to the heat exchanger 126 may be smaller than the basic flow amount Y initially measured. Therefore, when this case is detected, the control device 110 stores a newly measured amount of water X in the memory 220 as a new basic flow amount Y and uses the newly measured amount of water as a reference value for the subsequent determination process (steps S530 and S560). Thereafter, the control is returned to step S520.

In step S580, the control device 110 determines whether an end condition for the instant hot-water mode 316 is satisfied. The end condition of the instant hot-water mode 316 is a condition that any one of steps S341, 343, and 350 shown in FIG. 3 is performed. When the control device 110 determines that the end condition is satisfied (YES in step S580), the control device 110 switches the control to step S590. Otherwise (NO in step S580), the control device 110 switches the control to step S520.

In step S590, the control device 110 ends instant hot-water circulation mode 318. The action mode of the hot-water supply device 100 is switched to the hot-water supply combustion mode 315 (step S350). The command to the combustion mechanism 128 is a normal stop, and the combustion mechanism 128 ends the combustion. The command to the bypass water amount servo 122 is a hot-water discharge standby, and the valve maintains the specified opening degree. The command to the total water amount servo 130 is a hot-water discharge standby, and the valve maintains the specified opening degree.

The technical features disclosed above can be summarized as follows.

(1) According to one embodiment, the control device 110 of the hot-water supply device switches the instant hot-water circulation mode 318 to the hot-water supply mode based on the fact that, when the circulation pump 120 is stopped in the instant hot-water circulation mode 318, the amount of the water flowing into the heat exchanger 126 is equal to or greater than the reference amount (MOQ) specified for starting the combustion of the heat exchanger 126, or the warm water flows out from the hot-water supply tap 21 in the instant hot-water circulation mode 318 (step S340).

(2) In one aspect, based on the fact that the temperature of the water flowing into the heat exchanger 126 or the temperature of the water flowing out from the heat exchanger 126 is equal to greater than the temperature preset for stopping the instant hot-water circulation running, the control device 110 determines that another tap interruption in which the warm water flows out from the hot-water supply tap 21 is generated.

(3) In one aspect, based on the fact that an amount of water measured after the hot-water supply devices 100 and 400 start to run is greater than an amount of water measured when the hot-water supply device 100 and 400 start to run by a preset amount, the control device 110 determines that another tap interruption is generated. For example, the control device 110 sequentially stores the measured amounts of water in the memory 220. A storage timing is not particularly limited and can be set arbitrarily according to a storage capacity of the memory 220. For example, the control device 110 stores each detection value of the water amount sensor 131 in the memory 220 every hour. The above determination is performed, for example, in real time.

(4) In one aspect, the control device 110 starts the combustion performed by the combustion mechanism 128 based on switching from the instant hot-water circulation mode 318 to the hot-water supply combustion mode 315. Thereby, even when another tap interruption is detected, the warm water having the set temperature can be rapidly supplied from the hot-water supply devices 100 and 400.

(5) In one aspect, based on the fact that the temperature of the water flowing into the heat exchanger 126 or the temperature of the water flowing out from the heat exchanger 126 is equal to or lower than the preset temperature when the combustion is not performed in the hot-water supply devices 100 and 400, the control device 110 starts the operation of the circulation pump 120 (step S342).

(6) In one aspect, based on the fact that when the circulation pump 120 is stopped in the case where the combustion in the hot-water supply devices 100 and 400 is prohibited, running conditions preset for preventing the circulation pump 120 from being locked are satisfied, the control device 110 operates the circulation pump 120 (the pump independently running mode 312).

(7) In one aspect, the preset running conditions include: the temperature of the water flowing into the heat exchanger 126 or the temperature of the warm water flowing out from the heat exchanger 126 being equal to or lower than the preset temperature, or a preset time having elapsed after the circulation pump 120 is stopped and the amount of the water flowing into the heat exchanger 126 is equal to or smaller than the reference amount (MOQ) specified to start the combustion of the heat exchanger 126.

(8) According to another aspect, a method of controlling the hot-water supply devices 100 and 400 is provided. This control method is executed by the control device 110. According to still another aspect, the disclosed technical features can be realized as a program for causing a computer (for example, the CPU 210) to execute the control method, or as a nonvolatile computer-readable data recording medium that stores the program.

[Effects of Embodiments]

As described above, according to the embodiment, the hot-water supply device 100 can suppress energy consumption by stopping the circulation pump 120 based on a judgment result of another tap interruption.

In the pump independently running mode 312, the hot-water supply device 100 can drive the circulation pump 120 in a state that combustion is prohibited. Thus, the freezing prevention running while the hot-water supply device 100 is in a non-combustion state can be performed, and fuel consumption during the freezing prevention running can be suppressed.

In addition, the hot-water supply device 100 does not have a circulation circuit and does not have a circulation water amount sensor, but can detect another tap interruption (step S540). Therefore, when another tap interruption is detected, the hot-water supply device 100 stops the running of the circulation pump 120, and the warm water in the hot-water discharge path 152 flows toward the hot-water supply tap 21 through the hot-water discharge portion 20. As a result, the warm water in the hot-water discharge path 152 is not returned to the water entry path 150 by the circulation pump 120 via the flow path 153, and thus consumption of combustion energy can be suppressed.

The embodiments disclosed this time should be considered as illustrative in all points and not restrictive. The scope of the present invention is shown not by the above description but by the claims, and is intended to include meanings equivalent to the claims and all modifications within the scope.

What is claimed is:

1. A hot-water supply device having plural action modes, comprising:

a can body which is arranged between a water entry path and a hot-water discharge path;

a heat exchanger which is equipped inside the can body and heats water;

a circulation pump which is arranged in a circulation passage to send all or part of water flowing out from the hot-water discharge path of the heat exchanger to the water entry path of the heat exchanger and which is configured to send the water to the heat exchanger;

a water amount sensor which measures an amount of water flowing into the heat exchanger;

a temperature sensor which measures a temperature of the water flowing into the heat exchanger;

a temperature sensor which measures a temperature of water flowing out from the heat exchanger; and a control device being configured to control an action of the hot-water supply device, wherein the plural action modes comprise a hot-water supply mode in which warm water is supplied to the outside of the hot-water supply device, and an instant hot-water circulation mode in which water is circulated inside the hot-water supply device, and the control device is configured to switch the instant hot-water circulation mode to the hot-water supply mode based on the fact that, in the instant hot-water circulation mode, the control device is configured such that it determines that the water flows out from the hot-water supply tap based on the fact that an amount of water measured after the hot-water supply device starts to run is greater than an amount of water measured when the hot-water supply device starts to run by a preset amount, water flows out from a hot-water supply tap, when the amount of water measured after the hot-water supply device starts to run is less than a basic flow amount which is determined by the amount of water measured at the start of a first operation of the water heater by the preset amount, relearn the basic flow amount according to the amount of water at that time.

2. The hot-water supply device according to claim 1, wherein the control device is configured to determine that the water flows out from the hot-water supply tap based on the fact that an amount of water measured after the hot-water supply device starts to run is greater than an amount of water measured when the hot-water supply device starts to run by a preset amount.

3. The hot-water supply device according to claim 2, wherein the control device is configured to start combustion in the hot-water supply device based on switching from the instant hot-water circulation mode to the hot-water supply mode.

4. The hot-water supply device according to claim 3, wherein the control device is configured to start an operation of the circulation pump based on the fact that, when the combustion is not performed, a temperature of water flowing into the can body or a temperature of water flowing out from the can body is equal to or lower than a preset temperature.

5. The hot-water supply device according to claim 4, wherein the control device is configured to operate the circulation pump based on the fact that, while the circulation pump is stopped when the combustion in the hot-water supply device is prohibited, running conditions preset to operate the circulation pump are satisfied.

6. The hot-water supply device according to claim 5, wherein the preset running conditions comprise:

the temperature of the water flowing into the can body or the temperature of the water flowing out from the can body being equal to or lower than the preset temperature; or a preset time having elapsed after the circulation pump is stopped and an amount of water flowing into the can body is equal to or smaller than a reference amount specified to start combustion of the can body.

7. The hot-water supply device according to claim 3, wherein the control device is configured to operate the circulation pump based on the fact that, while the circulation pump is stopped when the combustion in the hot-water supply device is prohibited, running conditions preset to operate the circulation pump are satisfied.

8. The hot-water supply device according to claim 2, wherein the control device is configured to start an operation of the circulation pump based on the fact that, when the combustion is not performed, a temperature of water flowing into the can body ora temperature of water flowing out from the can body is equal to or lower than a preset temperature.

9. The hot-water supply device according to claim 8, wherein the control device is configured to operate the circulation pump based on the fact that, while the circulation pump is stopped when the combustion in the hot-water supply device is prohibited, running conditions preset to operate the circulation pump are satisfied.

10. The hot-water supply device according to claim 2, wherein the control device is configured to operate the circulation pump based on the fact that, while the circulation pump is stopped when the combustion in the hot-water supply device is prohibited, running conditions preset to operate the circulation pump are satisfied.

11. The hot-water supply device according to claim 1, wherein the control device is configured to start combustion in the hot-water supply device based on switching from the instant hot-water circulation mode to the hot-water supply mode.

12. The hot-water supply device according to claim 11, wherein the control device is configured to start an operation of the circulation pump based on the fact that, when the combustion is not performed, a temperature of water flowing into the can body or a temperature of water flowing out from the can body is equal to or lower than a preset temperature.

13. The hot-water supply device according to claim 12, wherein the control device is configured to operate the circulation pump based on the fact that, while the circulation pump is stopped when the combustion in the hot-water supply device is prohibited, running conditions preset to operate the circulation pump are satisfied.

14. The hot-water supply device according to claim 11, wherein the control device is configured to operate the circulation pump based on the fact that, while the circulation pump is stopped when the combustion in the hot-water supply device is prohibited, running conditions preset to operate the circulation pump are satisfied.

15. The hot-water supply device according to claim 1, wherein the control device is configured to start an operation of the circulation pump based on the fact that, when the combustion is not performed, a temperature of water flowing into the can body or a temperature of water flowing out from the can body is equal to or lower than a preset temperature.

16. The hot-water supply device according to claim 15, wherein the control device is configured to operate the circulation pump based on the fact that, while the circulation pump is stopped when the combustion in the hot-water supply device is prohibited, running conditions preset to operate the circulation pump are satisfied.

17. The hot-water supply device according to claim 1, wherein the control device is configured to operate the circulation pump based on the fact that, while the circulation pump is stopped when the combustion in the hot-water supply device is prohibited, running conditions preset to operate the circulation pump are satisfied.

18. The hot-water supply device according to claim 17, wherein the preset running conditions comprise:

the temperature of the water flowing into the can body or the temperature of the water flowing out from the can body being equal to or lower than the preset temperature; or a preset time having elapsed after the circulation pump is stopped and an amount of water flowing into the can body is equal to or smaller than a reference amount specified to start combustion of the can body.

* * * * *